United States Patent [19]

Bentz

[11] Patent Number: 4,848,286

[45] Date of Patent: Jul. 18, 1989

[54] CERAMIC TIPED PIVOT ROD AND METHOD FOR ITS MANUFACTURE

[75] Inventor: Joseph C. Bentz, Columbus, Ind.

[73] Assignee: Cummins Engine Company, Inc., Columbus, Ind.

[21] Appl. No.: 250,069

[22] Filed: Sep. 28, 1988

[51] Int. Cl.[4] ..... F01L 1/14

[52] U.S. Cl. ..... 123/90.61; 123/90.51; 29/156.7 B

[58] Field of Search ..... 74/579 E; 29/156.7 B, 29/525; 403/282, 30; 123/90.61, 90.51

[56] References Cited

U.S. PATENT DOCUMENTS

| | | | |
|---|---|---|---|
| 2,434,080 | 1/1948 | Rosa | 123/90.61 |
| 2,960,080 | 11/1960 | Burnard et al. | 123/90.61 |
| 4,453,505 | 6/1984 | Holtzberg et al. | 123/90.61 |

FOREIGN PATENT DOCUMENTS

| | | | |
|---|---|---|---|
| 0046025 | 3/1980 | Japan | 29/156.7 B |
| 0146211 | 11/1980 | Japan | 29/156.7 B |
| 0013203 | 1/1982 | Japan | 123/90.61 |
| 0013204 | 1/1982 | Japan | 123/90.61 |
| 0742612 | 6/1980 | U.S.S.R. | 29/156.7 B |

*Primary Examiner*—Willis R. Wolfe
*Assistant Examiner*—Weilun Lo
*Attorney, Agent, or Firm*—Sixbey, Friedman, Leedom & Ferguson

[57] ABSTRACT

Pivot rods, such as push rods of the type found in fuel injector and engine cylinder valve drive trains, wherein a pivot element is formed of a ceramic material that is joined to a nonceramic mounting shaft as a tip portion thereof, and a method for its manufacture are improved by utilizing an attachment sleeve to interconnect the pivot element to the mounting shaft in an end-to-end abutting fashion. The attachment sleeve is secured to a portion of the pivot insert by a first interference fit securement and to an end portion of the mounting shaft by a second interference fit securement. The combined axial length of the first portion of the pivot insert and the end portion of the mounting shaft is greater than the axial length of the attachment sleeve for preventing load transmission between the mounting shaft and the pivot insert via the attachment sleeve and the diameters thereof are coordinated to the maximum tensile principle stress of the pivot insert and the thickness and material of the attachment sleeve to result in deformation of the attachment sleeve during creation of the interference fit securements without exceeding the maximum tensile principle stress of the ceramic and, preferably, so as to result in the attachment sleeve being deformed along its full length to a substantially constant outer diameter that is equal to that of the outer diameter of a second portion of the pivot insert and the body portion of the mounting shaft.

14 Claims, 2 Drawing Sheets

CERAMIC TIPED PIVOT ROD AND METHOD FOR ITS MANUFACTURE

BACKGROUND OF THE INVENTION

1. Technical Field

The present invention relates to pivot rods, such as push rods of the type found included in fuel injector valve drive trains and engine cylinder valve drive trains. In particular, the invention is directed to such pivot rods and methods for their manufacture wherein a pivot element formed of a ceramic material is joined to a nonceramic rod as a tip portion thereof.

2. Background Art

In copending, commonly owned U.S. patent application Ser. No. 022,229, filed Mar. 5, 1987, now U.S. Pat. No. 4,794,894, a pivot rod, such as a push tube of the type used in engine drive trains for operating fuel injectors and cylinder valves, has a ceramic pivot rod insert attached to an end of a mounting shaft by a direct interference fit securement without exceeding the maximum tensile principle stress of the ceramic material, either during assembly or during use, despite the fact that the insert projects axially beyond the end of the mounting shaft and despite manufacturing tolerances of the mounting shaft and pivot insert. As a result, a dramatically increased wear life, as is associated with the use of wear resisting ceramic materials, is obtained without requiring uneconomical precision tolerancing of the parts as a means for dealing with the fracture problem associated with the low tensile strength of such ceramic materials.

In the embodiments of said commonly owned application, a ceramic pivot element is secured within a receiving space of a mounting shaft which may be formed by either the hollow interior of a piece of tubular stock material or may be a recess machined into an end of a piece of solid rod stock material. In the first case, and in one form of the second case, a butt joint is formed between a circumferential shoulder of the ceramic pivot element and an end of the metal shaft. In such a case, in use, loads are transmitted from the pivot element to the shaft at this abutment joint, which can result in brittle cracking and failure of the ceramic, should the shoulder be loaded beyond the normal design load.

However, in the second case, such a problem can be avoided by producing an abutment joint, not between a circumferential shoulder of the ceramic pivot element and an end of the shaft, but rather between the bottom end of the ceramic pivot element and a bottom wall of the recess forming the receiving space of the shaft within the solid rod body. Nevertheless, since the joining of the ceramic pivot element to the mounting shaft is produced via an interference fit securement that produces plastic deformation of the peripheral wall of the mounting shaft at the portion defining the receiving space, a stress concentration occurs at the junction of the peripheral and bottom walls of the recess, where the peripheral wall is restrained from radial expansion. Thus, despite the ductility of the metal shaft, it is possible for excessive stress concentrations to be produced to an extent that may lead to failure of the metal shaft or joint at that location.

In Japanese Patent Application No. 57-13203, a push rod is disclosed wherein a ceramic tip element is indirectly joined to a solid plastic (carbon reinforced resin) shaft, with an end of the ceramic element abutting an end of the shaft, via a joint formed by a separate metallic pipe. The metallic pipe joint receives an end of the rod and is secured thereto by a friction fit, while the metallic pipe is joined to the ceramic tip element by being deformed radially into a circumferential indentation provided on the periphery of the ceramic tip element. This metallic pipe is formed of a material having a coefficient of a thermal expansion between that of the ceramic tip element and the carbon fiber reinforced resin shaft to prevent breakage of the ceramic tip element. However, the disclosure of this Japanese application does not deal with the basic problem of trying to create an interference fit between a metallic pipe element and a ceramic pivot element, and possesses the shortcoming that the higher coefficient of thermal expansion of the metallic pipe (combined with the effect of the even high coefficient of thermal expansion of the resin shaft) relative to that of the ceramic tip element which it joins to the resin shaft can result in the tip becoming loose at elevated temperatures, or as a result of repeated heating and cooling of the push rod, to an extent that undesirable behavior characteristics will be achieved, particularly at increased operational speeds.

Thus, it is desirable to enable the benefits of the above-noted, commonly owned invention to be achieved without creation of undesirably high stress concentrations and without creating a pivot rod that is subject to overstressing, without going to a sleevetype attachment that is subject to the shortcomings of an arrangement as disclosed in the noted Japanese Application.

DISCLOSURE OF THE INVENTION

In view of the foregoing, it is an object of the present invention to provide a pviot rod, such as a push tube of the type used in engine drive trains for operating fuel injectors and cylinder valves, wherein a ceramic pivot insert may be attached to a mounting shaft by an interference fit securement without creating conditions which will result in damage to the ceramic pivot insert or the mounting shaft, either during assembly or during use, despite manufacturing tolerances of the mounting shaft and pivot insert, to a greater degree than heretofore possible.

It is a further object of the present invention to enable the mounting shaft to be formed of a solid rod and joined to the ceramic pivot insert in an end-to-end abutting fashion for the direct transference of loading from the pivot insert to the mounting shaft.

It is yet another object of the present invention to be able to connect the ceramic pivot insert to the mounting shaft by an interference fit securement thereof to an attachment sleeve without exceeding the maximum tensile principle stress of the ceramic material, and in a manner which enables the attachment sleeve to serve no role in the transference of axial loading from the mounting shaft to the ceramic pivot insert, thereby serving to further prevent damage to the ceramic pivot insert.

Still another object of the present invention is to provide a method of manufacturing a pivot rod which will achieve the above set forth objects.

It is a specific object of the present invention to provide a method of manufacturing a pivot rod with a pivot insert of a ceramic material wherein the thickness and material composition of an attachment sleeve, which receives a portion of the ceramic pivot insert and an end of a nonceramic mounting shaft, is coordinated to the maximum tensile principle stress of the ceramic material so that the peripheral wall will plastically deform under a stress below the maximum tensile principle stress of the ceramic material, whereby securement of the pivot insert to the peripheral wall of the mounting shaft by an interference fit will not result in the maximum tensile principle stress of the ceramic material being exceeded, despite variations in the degree of diametral interference between a peripheral wall of the attachment sleeve defining the receiving space for the received portion of the pivot insert and end portion of the mounting shaft during formation of the interference fit, and by ensuring that the press fit securement causes the end portion of the mounting shaft and the inserted portion of the ceramic pivot insert to be in an end-to-end abutting relationship, with the inserted portions of the ceramic pivot insert and mounting shaft having a greater combined length than the length of the attachment sleeve in a manner ensuring that axial loading is not transmitted between the ceramic pivot insert and mounting shaft via the attachment sleeve.

These and other objects in accordance with the present invention are achieved via a preferred embodiment of the present invention which takes advantage of relationships between principle tensile stress and diametral interference that have previously been determined in accordance with the invention disclosed in the above-noted, commonly owned U.S. patent application Ser. No. 022,229, filed Mar. 5, 1987, now U.S. Pat. No. 4,749,894. Thus, for the sake of brevity, the details of these relationships will not be reiterated in this application. Instead, the reader's attention is directed to the noted commonly owned application (see, for example, the discussion of FIGS. 1 and 8 thereof) which is hereby incorporated by reference.

The present invention, while utilizing the same relationships as disclosed in connection with said U.S. Pat. No. 4,794,894, improves upon the method and pivot rod thereof by constructing the joint by which the pivot insert of ceramic material is secured to the metal mounting shaft of a sleeve that only fixes or holds the ceramic pivot insert in place, but does not transmit the load carried by the pivot insert or mounting shaft through the creation of a butt joint between the ceramic and metal components that serves to transmit this load. Furthermore, the design in accordance with the preferred embodiment positively locates a ceramic pivot insert relative to the metal mounting shaft without using a narrow shoulder which may be loaded beyond the normal design load and become overstressed, resulting in brittle cracking and failure of the ceramic, and without the initially mentioned problems associated with utilizing a mounting socket which may become overstressed at the junction between its bottom and side walls.

These and other characteristics, features, and benefits of the present invention will become more apparent from the following detailed description and accompanying drawings.

BEST MODE FOR CARRYING OUT THE INVENTION

Figure 1:
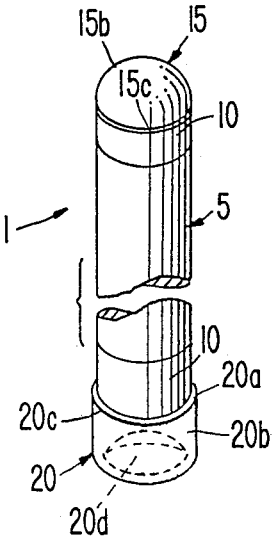
FIG. 1 is a perspective view of a pivot rod in accordance with a preferred embodiment of the present invention.

FIG. 1 illustrates a pivot rod in accordance with a preferred embodiment of the present invention, and is designated, generally, by the reference numeral 1. Such a pivot rod, as noted later, may serve as a push rod of the type finding particular utility in drive trains as described relative to FIGS. 3 and 4. Pivot rod 1 is comprised of a mounting shaft 5, a pair of attachment sleeves 10, and a pair of pivot inserts 15, 20. Each of the pivot inserts is formed of a ceramic material, such as silicon nitride, while the mounting shaft is a metal rod such as a piece of standard steel rod stock or a cast steel piece. Additionally, each of the sleeves 10 may be formed of a piece of "off the shelf" tubing, such as MT 1020, 1021 steel tubing of a standard size, tolerances, and wall thickness, as specified in ASTM A 513.

Figure 2:
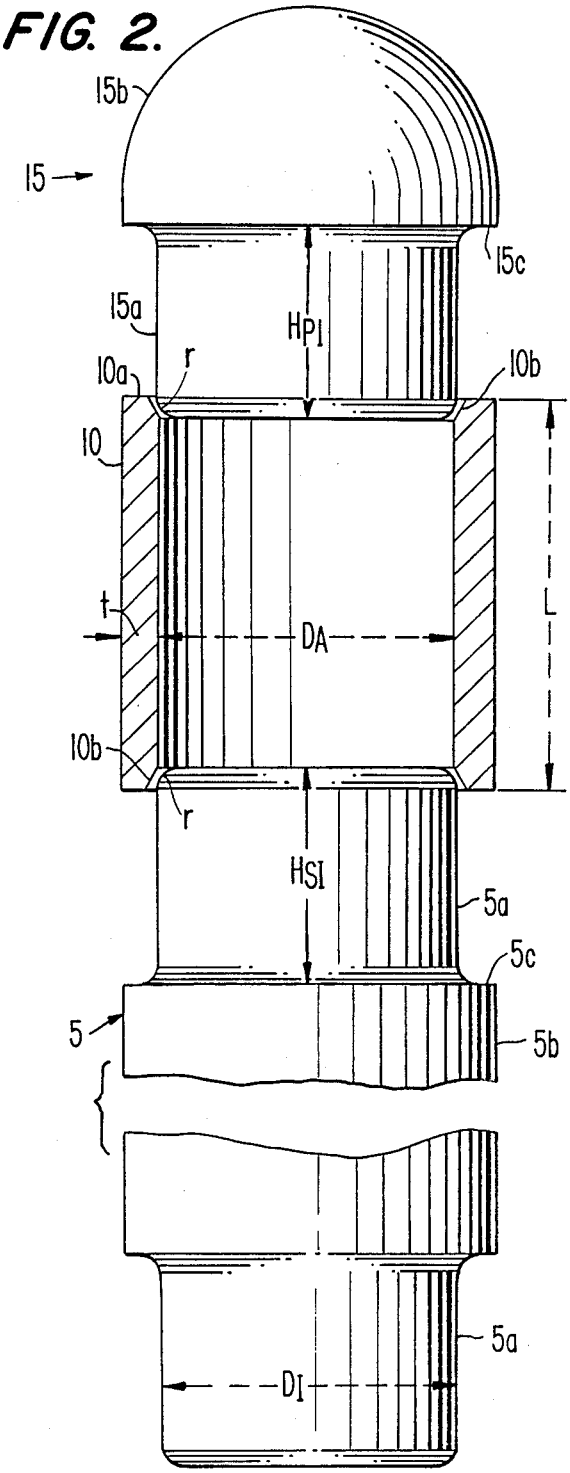
FIG. 2 is a schematic representation depicting the dimensional relationships between a ceramic pivot insert, attachment sleeve, and mounting shaft of the preferred embodiment pivot rod, prior to assembly thereof, for purposes of explaining the method in accordance with the present invention.

As can be seen from FIG. 2, the mounting shaft 5 of pivot rod 1 has reduced diameter end portions 5*a* at each of opposite ends of a body portion 5*b* onto which attachment sleeve 10 is interference fit. Similarly, a reduced diameter first portion 15*a* of the pivot insert 15 (or the corresponding reduced diameter portion 20*a* of pivot insert 20, only a portion of which is visible in FIG. 1) is press fit secured within the receiving space defined by the peripheral wall of attachment sleeve 10, after the attachment sleeve has been secured to mounting shaft 5 for the reasons noted in the following paragraph. In this regard, the thickness t and composition of the attachment sleeve 10, as well as the extent of the interference (which corresponds to the difference between the diameter D of the attachment sleeve 10 and the diameter $D_I$ of the end portions 5*a* and the corresponding diameter of the first portions 15*a*, 20*a* of the pivot inserts 15, 20) are selected in accordance with the above-referenced relationships of copending Ser. No. 022,229, so as to result in the peripheral wall of attachment sleeve 10 being plastically deformed by the first portion 15*a*, 20*a* of the pivot insert 15, 20 and by the end portion 5*a* of the mounting shaft 5 during formation of the interference fits without exceeding the maximum tensile principle stress of the ceramic material of the pivot inserts, despite variations in the degree of diametral interference existing between the internal diameter of the peripheral wall circumscribing the receiving space of the attachment sleeve and the external diameter of the first portion of the pivot insert resulting from manufacturing tolerances.

Additionally, in accordance with the present invention, the combined length composed of the axial length $H_{PI}$ of the first portion 15*a*, 20*a* of the respective pivot insert and the axial length $H_{SI}$ of the end portion 5*a* of the mounting shaft 5 is made to be greater than the axial length L of the attaching sleeve 10 to prevent damage to the brittle ceramic material of the pivot insert 15, 20, both during formation of the joint between it and the mounting shaft and to prevent fracturing during use due to the transmission of axial loads between the pivot insert 15, 20 and the mounting shaft 5 via the attachment sleeve 10. That is, the first, insertion portion 15*a*, 20*a* is joined to a second, pivot surface portion 15*b* (which is convexly curved) or 20b (which is provided with a concavely curved recess 20d) via a shoulder 15c, 20c, respectively, to enable the pivot surface to be maximized while achieving the other benefits noted in the following paragraph. However, such a shoulder 15c, 20c may be damaged if it were to impact against the facing end surface 10a of the attachment sleeve during creation of the interference fit securement. Also, brittle cracking leading to failure of the ceramic pivot insert could be experienced due to overstressing of this shoulder or the fillet interconnecting it to the first portion 15a, 20a, as could occur if the parts were assembled in a fashion permitting axial loads to be transmitted between the shoulders 5c of the mounting shaft and the respective shoulder 15c, 20c of the pivot insert 15, 20 via the attachment sleeve 10. It is also noted that the lengths $H_{PI}$ and $H_{SI}$ may be equal, but are not necessarily so, as they may be varied to make one relatively longer or shorter than the other as best suited to manufacturing considerations, so long as neither portion 5a or 15a, 20a is made so long as to impose bending stresses of an extent great enough to cause failure of the attachment, or so short as to provide an inadequate length for a secure fastening of the attachment sleeve 10 thereto.

Still further, it is desirable for aesthetic and other reasons, to produce a pivot rod which gives the appearance, as much as is possible, of a one-piece rod and does not either increase the maximum diameter of the pivot rod 1 or reduce the diameter of the pivot surfaces (keeping in mind that, in practice, such pivot rods will have to pass through bores of the engine structure with which it is associated as part of an overall drive train). Therefore, the diameter $D_I$ of the end portion 5a of the mounting shaft and of the insertion portion 15a, 20a of the ceramic pivot inserts 15, 20 is reduced relative to the outer diameter of body portion 5b of the mounting shaft and of the second portion 15b, 20b of the pivot inserts at shoulder 5c, 15c, 20c, by an amount that is coordinated to the thickness t of the attachment sleeve and the extent to which the attachment sleeve is deformed as a result of the interference securements produced so as to result in the attachment sleeve being deformed throughout its axial length to a substantially equal extent and so as to have a deformed outer diameter that is substantially constant and equal to the outer diameter of the second portions of the pivot inserts and body portion of the mounting shaft. In this regard, it is also pointed out that while, in the drawings, a noticeable gap is shown between the end face 10a of attachment sleeve 10 and the shoulder 15c, 20c of the pivot inserts 15, 20, respectively, such is for purposes of illustration only. In practice, such a gap will be less than one-half of a millimeter so as to be virtually indistinguishable from the gapless interface between shoulder 5c and the opposite end of attachment sleeve 10.

To facilitate the creation of the interference fit interconnections of the mounting shaft and pivot inserts with the attachment sleeve 10, the inner rim 10b of the attachment sleeve is chamfered and a radiused or chamfered peripheral edge r provided on end portion 5a of the mounting shaft and insertion portion 15a, 20a of the pivot inserts 15, 20. In this way, the larger portion to be inserted can be guided into the receiving space of the attachment sleeve 10 which will be enlarged thereby.

Figure 3:
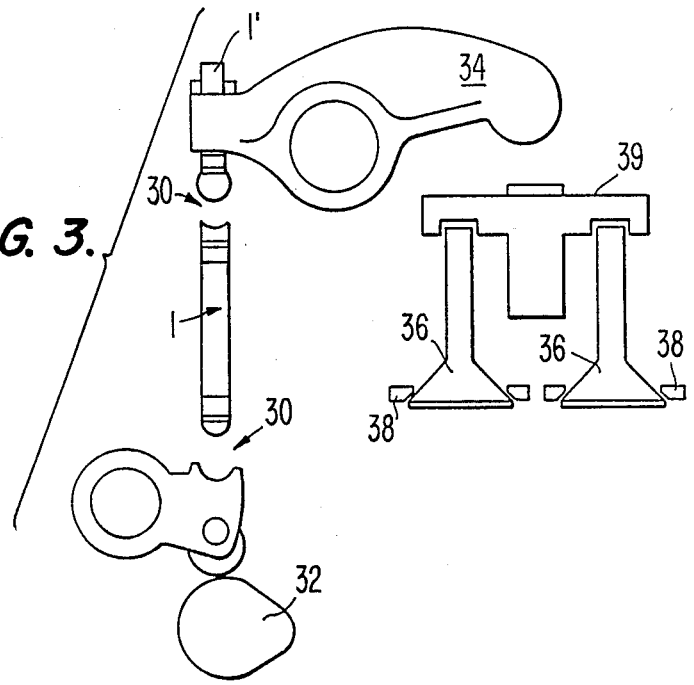
FIGS. 3 and 4 are schematic representations, respectively, of a cylinder head valve and fuel injector drive train incorporating a pivot rod in accordance with the present invention.
Figure 4:
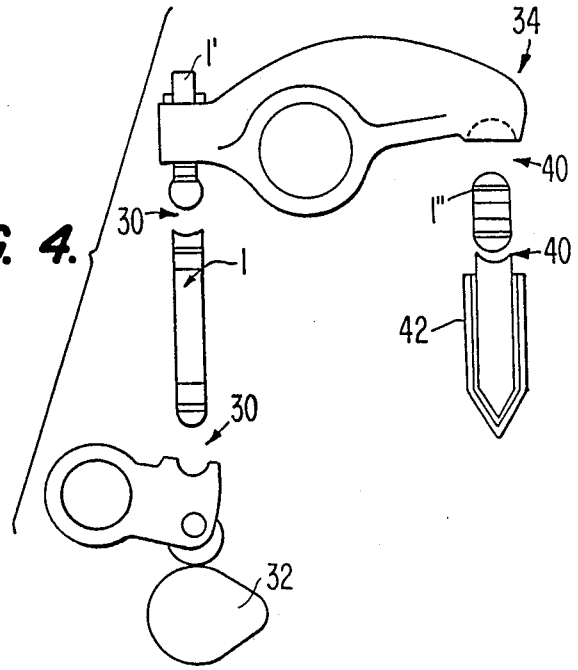

Even though the pivot rod described above is formed with a convex surface at one end and a concave surface at the opposite end, such need not necessarily be the case, as can be seen with reference to FIGS. 3 and 4, which schematically show drive trains of the type which may be significantly improved through the utilization of ceramic ball and socket joints to increase the compressive loads to which such joints may be subjected and the wear life thereof. For example, FIG. 3 depicts an engine cylinder head valve drive train wherein ball and socket joints 30 are created at each of opposite ends of the push rod 1 to transmit movement produced by a cam 32 to a valve rocker lever 34 that is used to seat and unseat valves 36 with respect to the valve seat inserts 38 via the cross bridge 39. However, this drive train also utilizes a pivot rod 1' wherein only a single pivot insert is provided at one end thereof, this being a convex pivot insert 15.

Furthermore, in the case of the fuel injector drive train of FIG. 4, in addition to being provided with joints 30 for transmission of force from the cam 32 to the rocker arm 34 via pivot rods 1, 1', ball and socket joints 40 are provided by a further modified pivot rod 1'' that acts between the rocker arm 34 and the injector piston 42. This pivot rod 1'' is provided with convex surfaced pivot inserts 15 at each of opposite ends thereof. Likewise, for other applications, it is possible to produce pivot rods in accordance with the present invention which have only a single concave pivot surface at one end or which have concave pivot inserts at each of opposite ends thereof.

A pivot rod produced in accordance with the foregoing has been found to achieve all of the benefits of significantly increased wear life and the simplification of production associated with a pivot rod as produced in accordance with Ser. No. 022,229, without creating any potential areas for stress failure of the ceramic material of the pivot inserts or of the joint between the inserts and the mounting shaft during use or as a result of operational stresses. Likewise, a pivot rod produced in accordance with the present invention is not prone to stress failure or loosening due to thermal effects.

INDUSTRIAL APPLICABILITY

The present invention finds utility, in particular, in connection with cylinder head valve and fuel injected drive train components for engines, such as diesel engines. However, the invention will also find utility for any application where it will be advantageous or necessary to utilize a ceramic ball and/or socket component due to the high compressive stresses to which the part will be subjected and/or where the value of a dramatically increased wear-free life outweighs the cost associated with using ceramic materials, which materials are more expensive than the metals which are conventionally used for such pivot parts.

I claim:

1. A pivot rod comprising:

(A) a mounting shaft;

(B) an attachment sleeve having a hollow interior receiving space;

(C) a pivot insert formed of a ceramic material having a maximum tensile principle stress;

(D) a first interference fit securement of a first portion of the pivot insert, which is disposed within said receiving space with a second portion of the pivot insert projecting axially therefrom, to a peripheral wall of said attachment sleeve circumscribing said receiving space, said interference fit securement being constructed as a means for preventing the maximum tensile principle stress of the ceramic material from being exceeded, despite variations in the degree of diametral interference existing between an internal diameter of the peripheral wall circumscribing said receiving space and an external diameter of said first portion of the pivot insert resulting from manufacturing tolerances of the attachment sleeve and pivot insert, via said peripheral wall having been plastically deformed by said first portion of the pivot insert during formation of said interference fit securement through coordination of the thickness and material composition of said peripheral wall with said maximum tensile principle stress; and (E) a second interference fit securement of an end portion of said mounting shaft within the interior receiving space of the attachment sleeve in abutting relation with an end face of said first portion of the pivot insert.

2. A pivot rod according to claim 1, wherein said pivot insert has a convexly-shaped contact surface on said second portion.

3. A pivot rod according to claim 1, wherein said pivot insert has a concavely-shaped contact surface in said second portion.

4. A pivot rod according to claim 1, wherein a pivot insert is mounted to each of opposite ends of the mounting shaft by an interference fit securement between a respective said attaching sleeve and a respective said pivot insert.

5. A pivot rod according to claim 1, wherein said first portion of said pivot insert and said end portion of the mounting shaft have an outer diameter that is reduced relative to the outer diameter of said second portion and of a body portion of the mounting shaft, respectively, by an amount coordinated to the thickness of said attachment sleeve and the extent to which said attachment sleeve is deformed as a result of said first and second interference fit securements and resulting in said attachment sleeve being of a substantially constant outer diameter along its length that is equal to the outer diameter of the second portion of the pivot insert and the body portion of the mounting shaft.

6. A pivot rod according to claim 5, wherein the combined axial length of said first portion of the pivot insert and the end portion of the mounting shaft is greater than the axial length of said attachment sleeve for preventing load transmission between said mounting shaft and said pivot insert via said attachment sleeve.

7. A pivot rod according to claim 6, wherein the axial length of said first portion of the pivot insert is approximately equal to that of said end portion.

8. A pivot rod according to claim 1, wherein the combined axial length of said first portion of the pivot insert and the end portion of the mounting shaft is greater than the axial length of said attachment sleeve for preventing load transmission between said mounting shaft and said pivot insert via said attachment sleeve.

9. A pivot rod according to claim 8, wherein the axial length of said first portion of the pivot insert is approximately equal to that of said first end portion.

10. A method of manufacturing a pivot rod having a mounting shaft and a pivot insert of a ceramic material, with a given maximum tensile principle stress, said pivot insert being positioned with a first portion thereof disposed within a hollow interior receiving space of an attachment sleeve that is secured on an end portion of the mounting shaft and with a second portion of the pivot insert projecting axially from said receiving space, comprising the steps of:

(A) coordinating the thickness and material composition of a peripheral wall of the attachment sleeve that circumscribes the receiving space with the maximum tensile principle stress of the ceramic material so that said peripheral wall will plastically deform under a stress below said maximum tensile principle stress;

(B) securing said first portion of the pivot insert to said peripheral wall of the attachment sleeve by an interference fit without exceeding the maximum tensile principle stress of the ceramic material, despite variations in the degree of diametral interference existing between an internal diameter of the peripheral wall and an external diameter of said first portion resulting from manufacturing tolerances of the mounting shaft and pivot insert, by producing plastic deformation of said peripheral wall by said first portion of the pivot insert during formation of said interference fit; and (C) interference fit securing the end portion of the mounting shaft within the interior receiving space of the attachment sleeve in abutting relation with an end face of said first portion of the pivot insert.

11. A method according to claim 10, wherein the combined length of the first portion of the pivot insert and the end portion of the mounting shaft is selected to be greater than the axial length of said attachment sleeve, and wherein step (C) is performed before step (B) so as to prevent axial contact between the second portion of said pivot insert and a facing end of said attachment sleeve, thereby ensuring that the second portion is not damaged during step (B) or as a result of the transmission of loads between said pivot insert and mounting shaft via said attachment sleeve.

12. A method according to claim 11, wherein steps (A)-(C) are performed so as to result in said attachment sleeve being deformed throughout its axial length to a substantial equal extent so as to have a deformed outer diameter that is substantially constant and equal to the outer diameter of said second portion and of a body portion of said mounting shaft.

13. A method according to claim 1, wherein steps (A)-(C) are performed so as to result in said attachment sleeve being deformed throughout its axial length to a substantial equal extent so as to have a deformed outer diameter that is substantially constant and equal to the outer diameter of said second portion and of a body portion of said mounting shaft.

14. A method according to claim 1, wherein said steps are performed for each of opposite ends of said mounting shaft.

* * * * *